US008307499B2

(12) United States Patent
Ruffo et al.

(10) Patent No.: US 8,307,499 B2
(45) Date of Patent: Nov. 13, 2012

(54) HANGER FOR WINDOW DRAPE AND SLIDE ASSEMBLY INCLUDING HANGER

(76) Inventors: Fabian Ruffo, San Diego, CA (US); James Ko, Kaohsiung (TW)

( * ) Notice: Subject to any disclaimer, the term of this patent is extended or adjusted under 35 U.S.C. 154(b) by 62 days.

(21) Appl. No.: 12/963,891

(22) Filed: Dec. 9, 2010

(65) Prior Publication Data

US 2012/0145860 A1 Jun. 14, 2012

(51) Int. Cl.
*E05D 15/00* (2006.01)

(52) U.S. Cl. ..... 16/87.2; 160/178.1 V

(58) Field of Classification Search ..... 16/87.2, 16/87.6 R, 87 R, 97, 102; 49/410, 411, 412, 49/409; 160/330, 340, 341, 123, 345–347, 160/167 R, 167 V, 168.1 R, 174 R, 176.1 R
See application file for complete search history.

(56) References Cited

U.S. PATENT DOCUMENTS 4,262,728 A * 4/1981 Debs ..... 160/168.1 R
4,964,191 A * 10/1990 Wyatt ..... 16/87.2
5,291,946 A * 3/1994 Ciriaci ..... 160/177 R
5,636,417 A * 6/1997 Eisenkolb ..... 24/716
6,000,456 A * 12/1999 Neverett ..... 160/178.1 V
6,098,246 A * 8/2000 Moir ..... 16/87.2
6,105,656 A * 8/2000 Hernandez et al. ..... 160/174 V
6,321,821 B1 * 11/2001 Wunsche ..... 160/178.1 V
6,457,509 B1 * 10/2002 Anderson et al. ..... 160/178.1 V
7,377,011 B2 * 5/2008 Sakakura ..... 16/87.6 R
2005/0278893 A1 * 12/2005 Abelen ..... 16/87.2

* cited by examiner

*Primary Examiner* — Chuck Y. Mah
(74) *Attorney, Agent, or Firm* — Rosenberg, Klein & Lee

(57) ABSTRACT

A hanger includes an elongated member having a rod with a plurality of positioning portions spaced in a vertical direction. An engaging portion is formed on a bottom of the rod for engaging with an engagement portion. A coupling block includes a connecting head. The coupling block further includes a body and a resilient plate that are located below the connecting head. The body and the resilient plate together define a passageway having an opening in a lower end thereof. The rod is slideable in the passageway in the vertical direction. The resilient plate includes a free end having a hook that is spaced from the body. At least a portion of the hook extends into the passageway. The hook is releasably engaged with a selected one of the positioning portions. The resilient plate is operable to disengage the hook from the positioning portions.

20 Claims, 11 Drawing Sheets

HANGER FOR WINDOW DRAPE AND SLIDE ASSEMBLY INCLUDING HANGER

BACKGROUND OF THE INVENTION

The present invention relates to a hanger for a window drape and a slide assembly including the hanger and, more particularly, to a length-adjustable hanger and a slide assembly including such a hanger.

Window drapes are generally used in indoor decoration and provide several functions including preventing peeking, adjusting indoor brightness and temperature, insulating heat, blocking dust, and providing decoration.

A wide variety of window drapes has been proposed to meet differing needs. Window drapes may include a plurality of slide assemblies for moving the drape. A type of slide assembly includes a slide having a sliding portion on each of two sides thereof for sliding along a track of a window drape. A hanger includes an engaging block engaged with an engaging groove in a bottom of the slide. A ring is provided at a bottom of the hanger and has a hole for engagement with one of a plurality of buttons on a snap tape that is fixed to a top edge of a drape of the window drape.

In use, a plurality of slide assemblies is mounted on the track, and the rings of the slide assemblies are engaged with the buttons on the snap tape. Thus, the slide assemblies are connected to the top edge of the drape such that the drape can be opened or closed by moving the slides along the track. A string is extended through the slides. The spacing between the slides can be adjusted. The snap tape is substantially S-shaped when viewed from top. Thus, the drape to which the snap tape is sewn is also substantially S-shaped, providing desired creasing effect.

However, the length of the slide assembly is fixed and, thus, not adjustable according to differing needs. Specifically, the vertical spacing between the ring and the bottom edge of the track is fixed, causing limitation to the width of the snap tape. Namely, the slide assembly can not be used with snap tapes of differing widths. The snap tape can be sewn to the top edge of the drape to provide stiffening effect for prevent drooping of the drape, preventing light beams from passing through the drooping portion of the drape, and avoiding weakening of the light-shielding effect of the drape. In a case that a wider snap tape is required to avoid drooping of the drape, the conventional slide assembly can not be adjusted in length according to the width of the wider snap tape. Thus, drooping of the drape is inevitable. Furthermore, the length of the snap tape can not be increased such that it is impossible to use a wider snap tape to prevent drooping of the drape. As a result, the creasing effect of the drape can not reach the bottom of the drape, failing to provide an aesthetically pleasing effect.

Thus, a need exists for a length-adjustable hanger for use with snap tapes of differing widths.

BRIEF SUMMARY OF THE INVENTION

It is the primary objective of the present invention to provide a length-adjustable hanger for a window drape and a slide assembly including such a hanger to solve the above disadvantages.

In an aspect, the present invention provides a hanger including an elongated member having a rod and an engaging portion. The rod includes a side having a plurality of positioning portions spaced in a vertical direction. The engaging portion is formed on a bottom of the rod. The engaging portion is adapted to engage with an engagement portion. A coupling block includes a connecting head. The coupling block further includes a body and a resilient plate. The body and the resilient plate are located below the connecting head. The body and the resilient plate together define a passageway having an opening in a lower end thereof. The rod is slideable in the passageway in the vertical direction. The resilient plate has a free end with a hook. The hook is spaced from the body by a spacing. At least a portion of the hook extends into the passageway. The hook is releasably engaged with a selected one of the plurality of positioning portions. The resilient plate is operable to disengage the hook from the plurality of positioning portions.

In use, a plurality of hangers is directly and slideably mounted to a track of a window drape. Alternatively, the hanger is mounted to a bottom of a slide to form a slide assembly, and a plurality of the slide assemblies is slideably mounted along the track of the window drape. The engaging portion on each hanger is coupled to one of a plurality of engagement portions of a snap tape that is fixed by sewing to a top edge of a drape of the window drape. A string is extended through the hangers to allow setting of the spacing between the hangers. The snap tape and the drape fixed to the snap tape are substantially S-shaped when viewed from top, providing creasing effect for the drape.

Since the hanger according to the present invention is adjustable, the spacing between the engaging portion and a bottom edge of the track can be changed according to the width of the snap tape. Thus, the hanger according to the present invention can be used with snap tapes of differing widths. Furthermore, the snap tape can be sewn to the top edge of the drape to provide stiffening effect for preventing drooping of the drape, preventing light beams from passing through the drooping portion of the drape, and avoiding weakening of the light-shielding effect of the drape. In a case that a wider snap tape is used to avoid drooping of the drape, the length-adjustable hanger according to the present invention allows use of the wider snap tape. Thus, drooping of the drape is avoided. Furthermore, use of the wider snap tape can provide stiffening effect such that the creasing of the drape can extend to the bottom of the drape, providing an aesthetically pleasing effect.

In another aspect, the present invention provides a slide assembly including a slide and a hanger. The slide includes a sliding portion at an intermediate portion thereof. The sliding portion is adapted to allow the slide to slide along a track of the window drape. The slide includes a connecting portion at a bottom portion thereof. The hanger includes an elongated member having a rod and an engaging portion. The rod includes a side having a plurality of positioning portions spaced in a vertical direction. The engaging portion is formed on a bottom of the rod. The engaging portion is adapted to engage with an engagement portion. The hanger further includes a coupling block having a connecting head connected to the connecting portion of the slide. The coupling block further includes a body and a resilient plate. The body and the resilient plate are located below the connecting head. The body and the resilient plate together define a passageway having an opening in a lower end thereof. The rod is slideable in the passageway in the vertical direction. The resilient plate has a free end with a hook. The hook is spaced from the body by a spacing. At least a portion of the hook extends into the passageway. The hook is releasably engaged with a selected one of the plurality of positioning portions. The resilient plate is operable to disengage the hook from the plurality of positioning portions.

In use, a plurality of the slide assemblies is slideably mounted along the track of the window drape with the engaging portion on each slide assembly coupled to a drape of a window drape. The engaging portion on each slide assembly is coupled to one of a plurality of engagement portions of a snap tape that is fixed by sewing to a top edge of a drape of the window drape. A string is extended through the hangers to allow setting of the spacing between the slide assemblies. The snap tape and the drape fixed to the snap tape are substantially S-shaped when viewed from top, providing creasing effect for the drape.

Since the slide assembly according to the present invention is adjustable, the spacing between the engaging portion and a bottom edge of the track can be changed according to the width of the snap tape. Thus, the slide assembly according to the present invention can be used with snap tapes of differing widths. Furthermore, the snap tape can be sewn to the top edge of the drape to provide stiffening effect for preventing drooping of the drape, preventing light beams from passing through the drooping portion of the drape, and avoiding weakening of the light-shielding effect of the drape. In a case that a wider snap tape is used to avoid drooping of the drape, the length-adjustable slide assembly according to the present invention allows use of the wider snap tape. Thus, drooping of the drape is avoided. Furthermore, use of the wider snap tape can provide stiffening effect such that the creasing of the drape can extend to the bottom of the drape, providing an aesthetically pleasing effect.

The present invention will become clearer in light of the following detailed description of illustrative embodiments of this invention described in connection with the drawings.

DETAILED DESCRIPTION OF THE INVENTION

Figure 1:
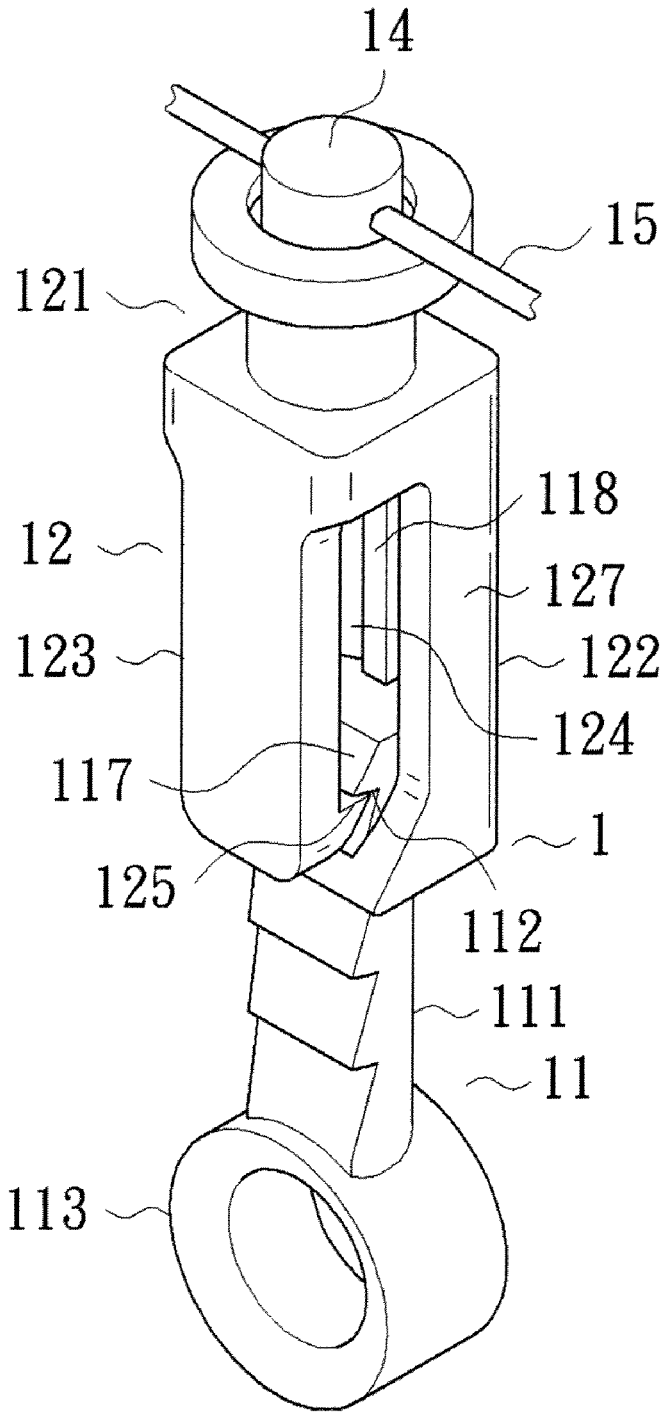
FIG. 1 shows a perspective view of a hanger according to the present invention with the hanger connected by a carrier to a string.
Figure 2:
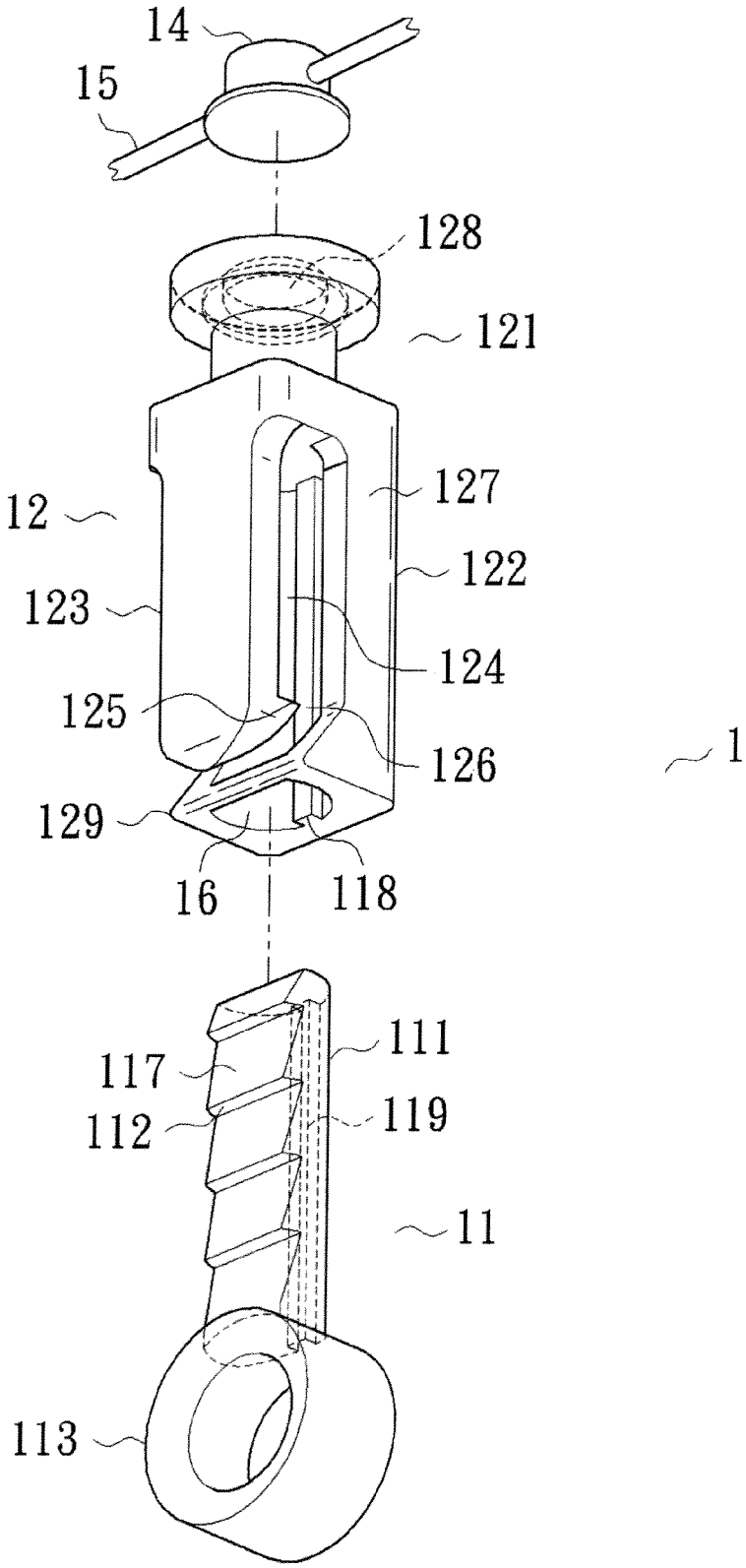
FIG. 2 shows an exploded, perspective view of the hanger, the carrier, and the string of FIG. 1.
Figure 3:
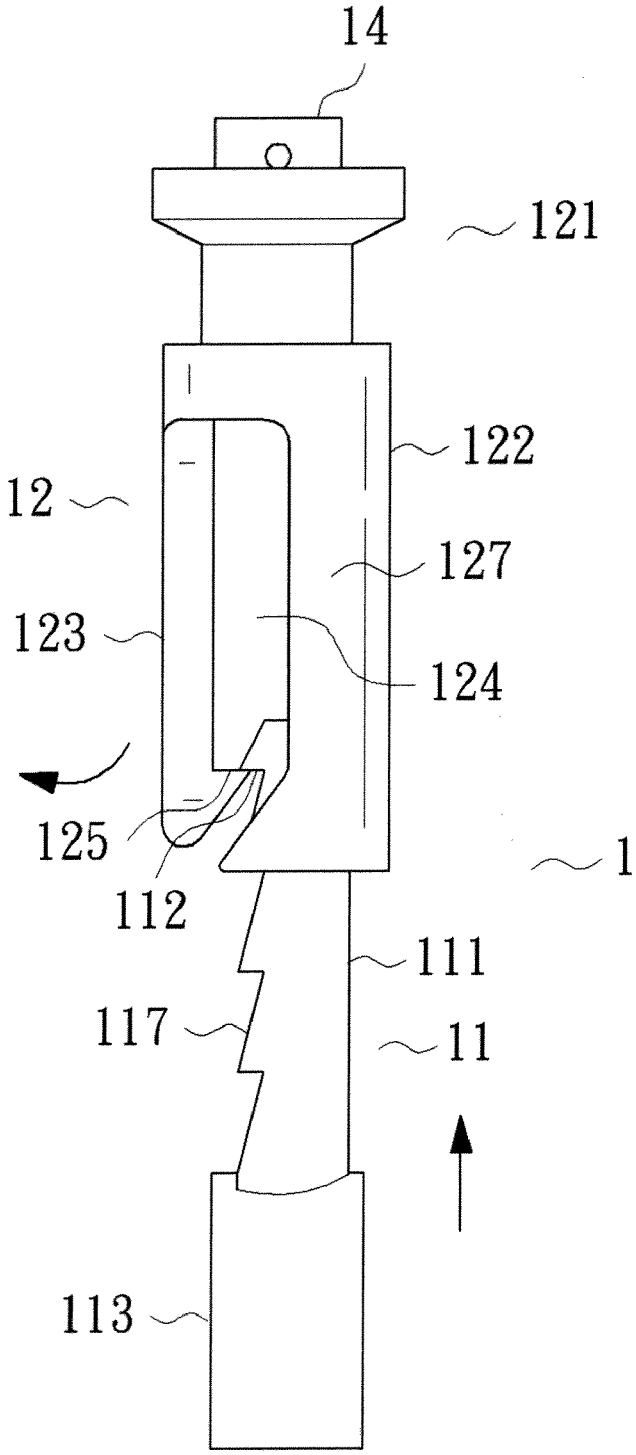
FIG. 3 shows a side view of the hanger of FIG. 1 with the hanger having a larger length.
Figure 4:
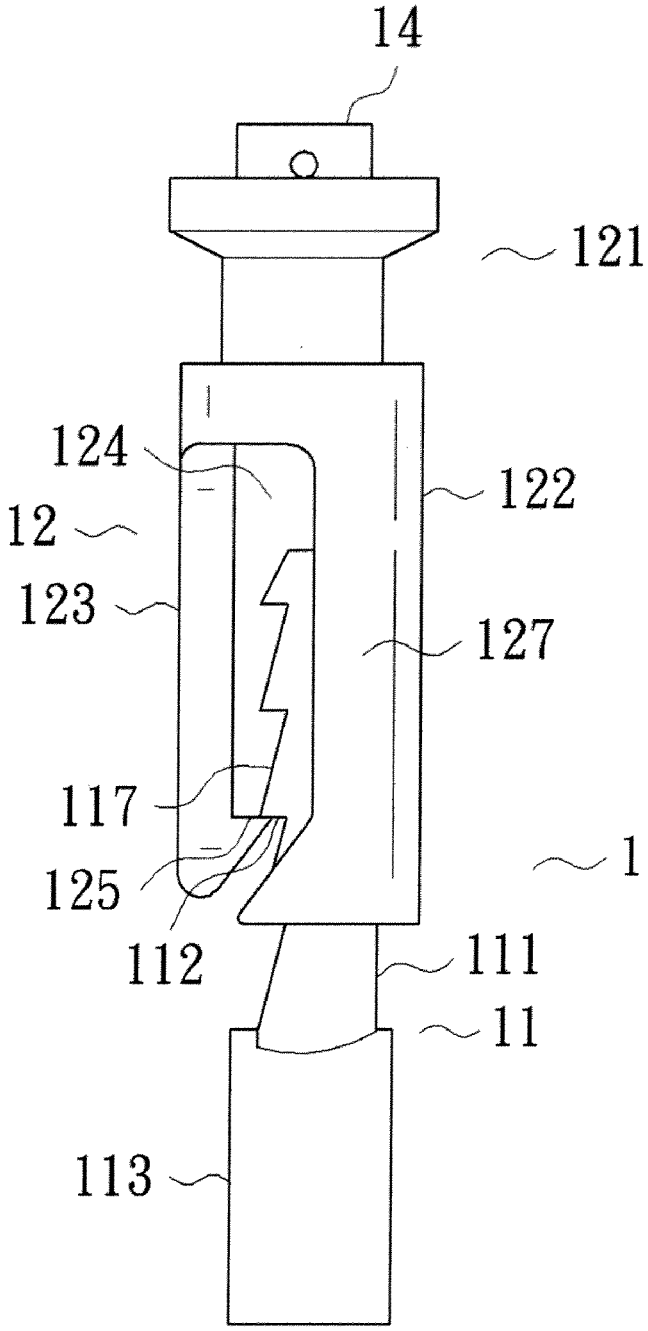
FIG. 4 shows a side view of the hanger of FIG. 1 with the hanger having a smaller length after adjustment.

With reference to FIGS. 1-6, a hanger 1 according to the present invention includes an elongated member 11. The elongated member 11 includes a rod 111 and an engaging portion 113. The rod 111 includes a side having a plurality of positioning portions 112 spaced in a vertical direction. The engaging portion 113 is formed on a bottom of the rod 111. The engaging portion 113 is adapted to engage with an engagement portion 114. In the illustrated embodiment, the engaging portion 113 is in the form of a ring, and the engagement portion 114 is in the form of a button on a snap tape 115 that can be connected to a top edge of a drape 116 by such as sewing.

The hanger 1 further includes a coupling block 12 having a connecting head 121. The coupling block 12 further includes a body 122 and a resilient plate 123. The body 122 and the resilient plate 123 are located below the connecting head 121. The body 122 and the resilient plate 123 together define an elongated passageway 124 having an opening in a lower end thereof. The rod 111 is slideable in the passageway 124 in the vertical direction. The resilient plate 123 has a free end with a hook 125. The hook 125 is spaced from the body 122 by a spacing 126. At least a portion of the hook 125 extends into the passageway 124. The hook 125 is releasably engaged with a selected one of the positioning portions 112. The resilient plate 123 is movable to disengage the hook 125 from the positioning portions 112. Thus, an overall length of the hanger 1 in the vertical direction can be adjusted. It can be appreciated that a root of the resilient plate 123 and a root of the body 122 do not have to be integrally formed with the connecting head 121. The resilient plate 123 and the body 122 can be connected to the connecting head 121 by other provisions. Furthermore, the resilient plate 123 can be of a type and shape different from those shown. The resilient plate 123 provides the required resiliency by its material properties. However, an elastic element such as a spring can be provided at the root of the resilient plate 123 to provide the required resiliency. In the illustrated embodiment, a lateral wall 127 extends from each of two sides of the body 122 to enhance the structural strength.

With reference to FIGS. 5-11, in use, the hanger 1 is adjustable in length, and a plurality of the hangers 1 is provided and slideable along a track 13 of a window drape. Alternatively, a hanger 1 can be coupled with a slide 2 to form a slide assembly 3, and a plurality of slide assemblies 3 are slideably mounted to the track 13. The engaging portion 113 on each hanger 1 is engaged with one of a plurality of engagement portions 114 on a snap tape 115 connected to a drape 116 of the window drape by sewing. Thus, the drape 116 can be opened or closed by sliding the hangers 1 along the track 13. Furthermore, a string 15 is extended through the hangers 1 and allows setting of the spacing between the hangers 1 such that the snap tape 115 and the drape 116 are substantially S-shaped when viewed from top, providing creasing effect for the drape 116.

Since the hanger 1 according to the present invention is adjustable in length, the problems encountered in the conventional sliding assemblies due to incapability of adjustment in the length are, thus, avoided.

Specifically, since the hanger 1 according to the present invention is adjustable, the spacing between the engaging portion 113 and a bottom edge of the track 13 can be changed according to the width of the snap tape 115. Thus, the hanger 1 according to the present invention can be used with snap tapes of differing widths. Furthermore, the snap tape 115 can be sewn to the top edge of the drape 116 to provide stiffening effect for preventing drooping of the drape 116, preventing light beams from passing through the drooping portion of the drape 116, and avoiding weakening of the light-shielding effect of the drape 116. In a case that a wider snap tape 115 is used to avoid drooping of the drape, the length-adjustable hanger 1 according to the present invention allows use of the wider snap tape 115. Thus, drooping of the drape is avoided. Furthermore, use of the wider snap tape 115 can provide stiffening effect such that the creasing of the drape 116 can extend to the bottom of the drape 116, providing an aesthetically pleasing effect.

Figure 5:
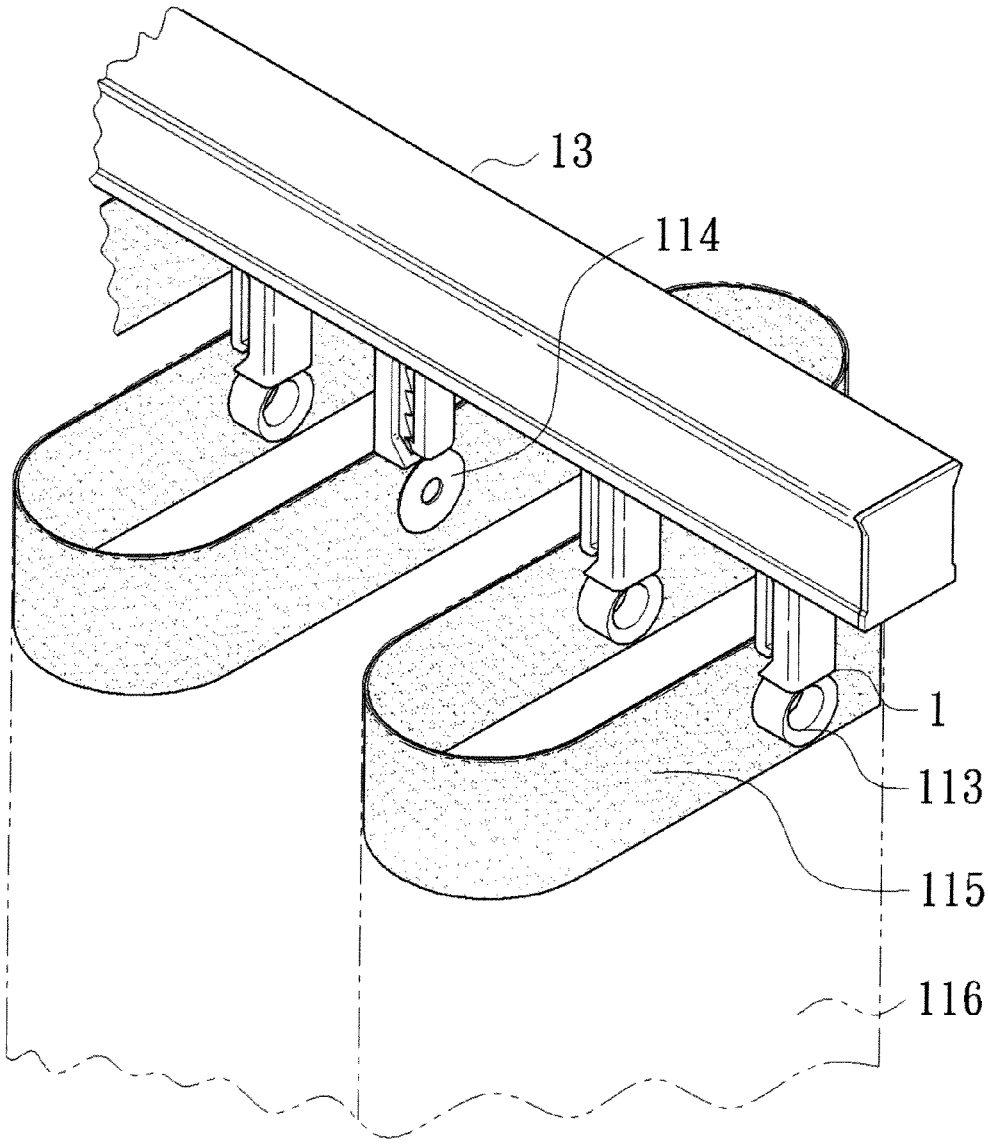
FIG. 5 shows a partial, perspective view of a track and a snap tape of a window drape using a plurality of hangers according to the present invention.
Figure 6:
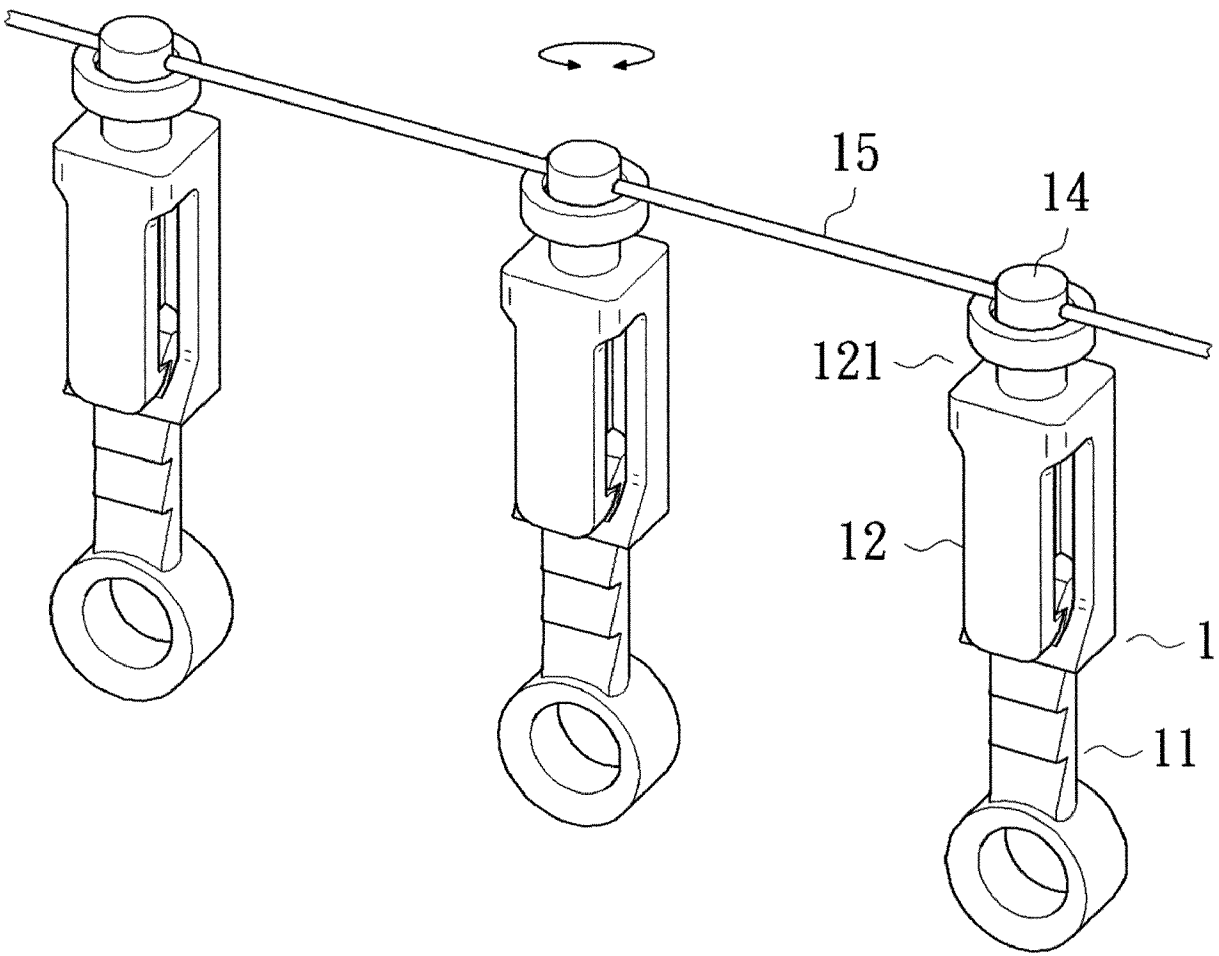
FIG. 6 shows a perspective view of a plurality of hangers according to the present invention connected by a string.
Figure 9:
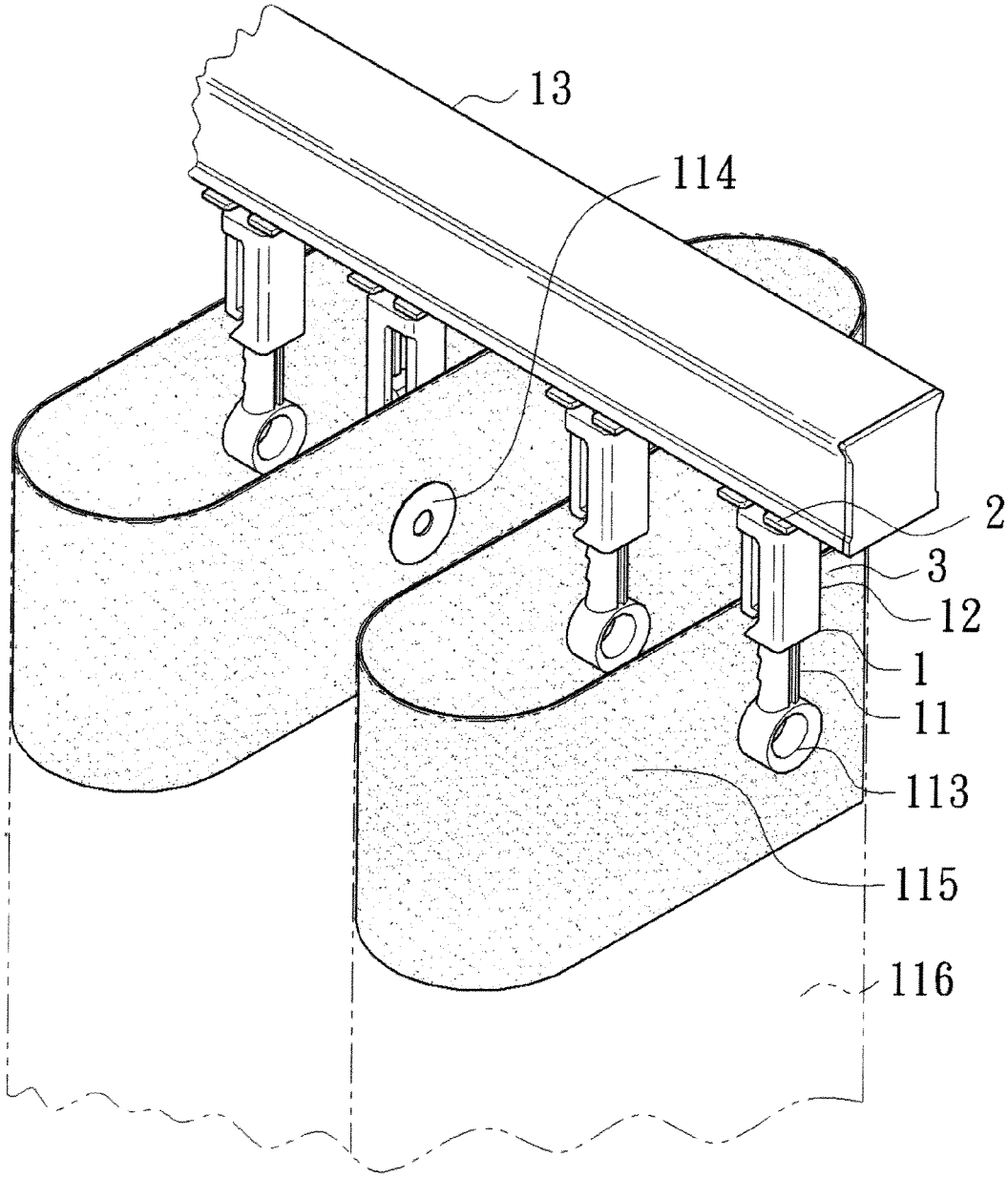
FIG. 9 shows a partial, perspective view of a track and a snap tape of a window drape using a plurality of slide assemblies according to the present invention.
Figure 11:
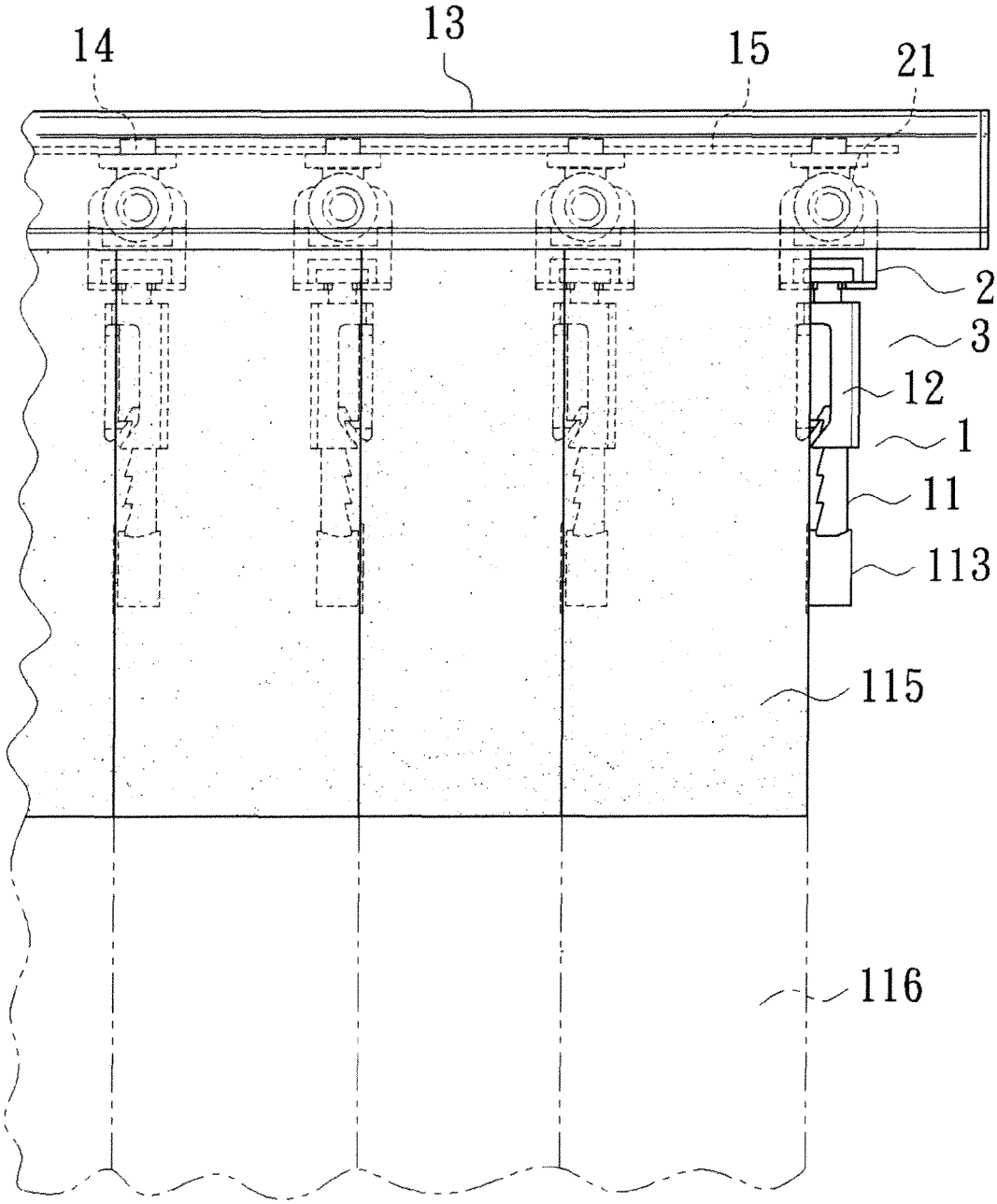
FIG. 11 shows a side view of the window drape of FIG. 9.

It can be appreciated that the hangers 1 shown in FIG. 5 are adjusted to be shorter for using with a narrower snap tape 115. The sliding assemblies 3 shown in FIG. 9 and FIG. 11 are adjusted to be longer for use with a wider snap tap 115. The main difference between the hanger 1 and the slide assembly 3 according to the present invention is use of a slide 2 in the slide assembly 3. With reference to FIGS. 9 and 11, it can be appreciated that the width of the snap 115 is not limited by using the hanger 1 and the slide assembly 3 according to the present invention.

With reference to FIGS. 1-4, the positioning portions 112 include a plurality of positioning steps. The hook 125 is engaged with a selected one of the positioning steps to adjust the overall length of the hanger 1 in the vertical direction. Furthermore, two adjacent positioning steps are connected by an inclined face 117. When the rod 111 is moved upward, the inclined face 117 reduces resistance to the upward movement of the rod 111. Thus, when a worker is installing the hanger 1, the worker can adjust the overall length of the hanger 1 with one hand such that the other hand of the worker is free to hold other objects or a ladder, providing convenience and enhancing safety during installation.

With reference to FIGS. 1-3 and FIG. 6, the connecting head 121 can include an engaging groove 128 in a top thereof. A carrier 14 is engaged with the engaging groove 128 of each hanger 1. The carriers 14 are connected by the string 15 for drawing the hangers 1 while allowing setting of the spacing between the hangers 1. In the illustrated embodiment, each carrier 14 is rotatable relative to the top of the associated hanger 1.

With reference to FIGS. 1-4, the body 122 and the rod 111 respectively include a rib 118 and a groove 119 on two mutually facing sides respectively of the body 122 and the rod 111. The groove 119 extends in a longitudinal side of the rod 111. The rib 118 is slideably received in the groove 119, allowing stable sliding movement of the rod 111.

With reference to FIGS. 1-4, the body 122 includes an annular rib 129 at the opening of the passageway 124. The annular rib 129 and the body 122 form a through-hole 16 through which the rod 111 extends. In the illustrated embodiment, the through-hole 16 has cross sections corresponding to those of the rod 111, providing stable sliding of the rod 111 in the passageway 124.

It can be appreciated that the hanger 1 according to the present invention can be used with slides of other types and sizes, not limited to the slide 21 shown in FIGS. 7-11.

With reference to FIGS. 7-11, the present invention further provides a slide assembly 3 for a window drape. The slide assembly 3 includes a slide 2 having a sliding portion 21 at an intermediate portion thereof. The sliding portion 21 allows the slide 2 to slide along a track 13 of the window drape. In the illustrated embodiment, the sliding portion 21 includes a roller on each side of the slide 2. The slide 2 includes a connecting portion 22 at a bottom portion thereof.

The slide assembly 3 further includes a hanger 1 includes an elongated member 11. The elongated member 11 includes a rod 111 and an engaging portion 113. The rod 111 includes a side having a plurality of positioning portions 112 spaced in a vertical direction. The engaging portion 113 is formed on a bottom of the rod 111. The engaging portion 113 is adapted to engage with an engagement portion 114. In the illustrated embodiment, the engaging portion 113 is in the form of a ring, and the engagement portion 114 is in the form of a button on a snap tape 115 that can be connected to a top edge of a drape 116 by such as sewing.

The hanger 1 further includes a coupling block 12 having a connecting head 121. The coupling block 12 further includes a body 122 and a resilient plate 123. The body 122 and the resilient plate 123 are located below the connecting head 121. The body 122 and the resilient plate 123 together define an elongated passageway 124 having an opening in a lower end thereof. The rod 111 is slideable in the passageway 124 in the vertical direction. The resilient plate 123 has a free end with a hook 125. The hook 125 is spaced from the body 122 by a spacing 126. At least a portion of the hook 125 extends into the passageway 124. The hook 125 is releasably engaged with a selected one of the positioning portions 112. The resilient plate 123 is movable to disengage the hook 125 from the positioning portions 112. Thus, an overall length of the hanger 1 in the vertical direction can be adjusted. It can be appreciated that a root of the resilient plate 123 and a root of the body 122 do not have to be integrally formed with the connecting head 121. The resilient plate 123 and the body 122 can be connected to the connecting head 121 by other provisions. Furthermore, the resilient plate 123 can be of a type and shape different from those shown. The resilient plate 123 provides the required resiliency by its material properties. However, an elastic element such as a spring can be provided at the root of the resilient plate 123 to provide the required resiliency. In the illustrated embodiment, a lateral wall 127 extends from each of two sides of the body 122 to enhance the structural strength.

With reference to FIGS. 9 and 11, in use, the slide assembly 3 is adjustable in length, and a plurality of the slide assemblies 3 is provided and slideable along a track 13 of a window drape. The engaging portion 113 on each slide assembly 3 is engaged with one of a plurality of engagement portions 114 on a snap tape 115 connected to a drape 116 of the window drape by sewing. Thus, the drape 116 can be opened or closed by sliding the hangers 1 along the track 13. Furthermore, a string 15 is extended through the hangers 1 and allows setting of the spacing between the hangers 1 such that the snap tape 115 and the drape 116 are substantially S-shaped when viewed from top, providing creasing effect for the drape 116.

Since the slide assembly 3 according to the present invention is adjustable in length, the problems encountered in the conventional sliding assemblies due to incapability of adjustment in the length are, thus, avoided.

Specifically, since the slide assembly 3 according to the present invention is adjustable, the spacing between the engaging portion 113 and a bottom edge of the track 13 can be changed according to the width of the snap tape 115. Thus, the slide assembly 3 according to the present invention can be used with snap tapes of differing widths. Furthermore, the snap tape 115 can be sewn to the top edge of the drape 116 to provide stiffening effect for preventing drooping of the drape 116, preventing light beams from passing through the drooping portion of the drape 116, and avoiding weakening of the light-shielding effect of the drape 116. In a case that a wider snap tape 115 is used to avoid drooping of the drape, the length-adjustable slide assembly 3 according to the present invention allows use of the wider snap tape 115. Thus, drooping of the drape is avoided. Furthermore, use of the wider snap tape 115 can provide stiffening effect such that the creasing of the drape 116 can extend to the bottom of the drape 116, providing an aesthetically pleasing effect.

The positioning portions 112 include a plurality of positioning steps. The hook 125 is engaged with a selected one of the positioning steps to adjust the overall length of the slide assembly 3 in the vertical direction. Furthermore, two adjacent positioning steps are connected by an inclined face 117. When the rod 111 is moved upward, the inclined face 117 reduces resistance to the upward movement of the rod 111. Thus, when a worker is installing the slide assembly 3, the worker can adjust the overall length of the slide assembly 3 with one hand such that the other hand of the worker is free to hold other objects or a ladder, providing convenience and enhancing safety during installation.

Figure 7:
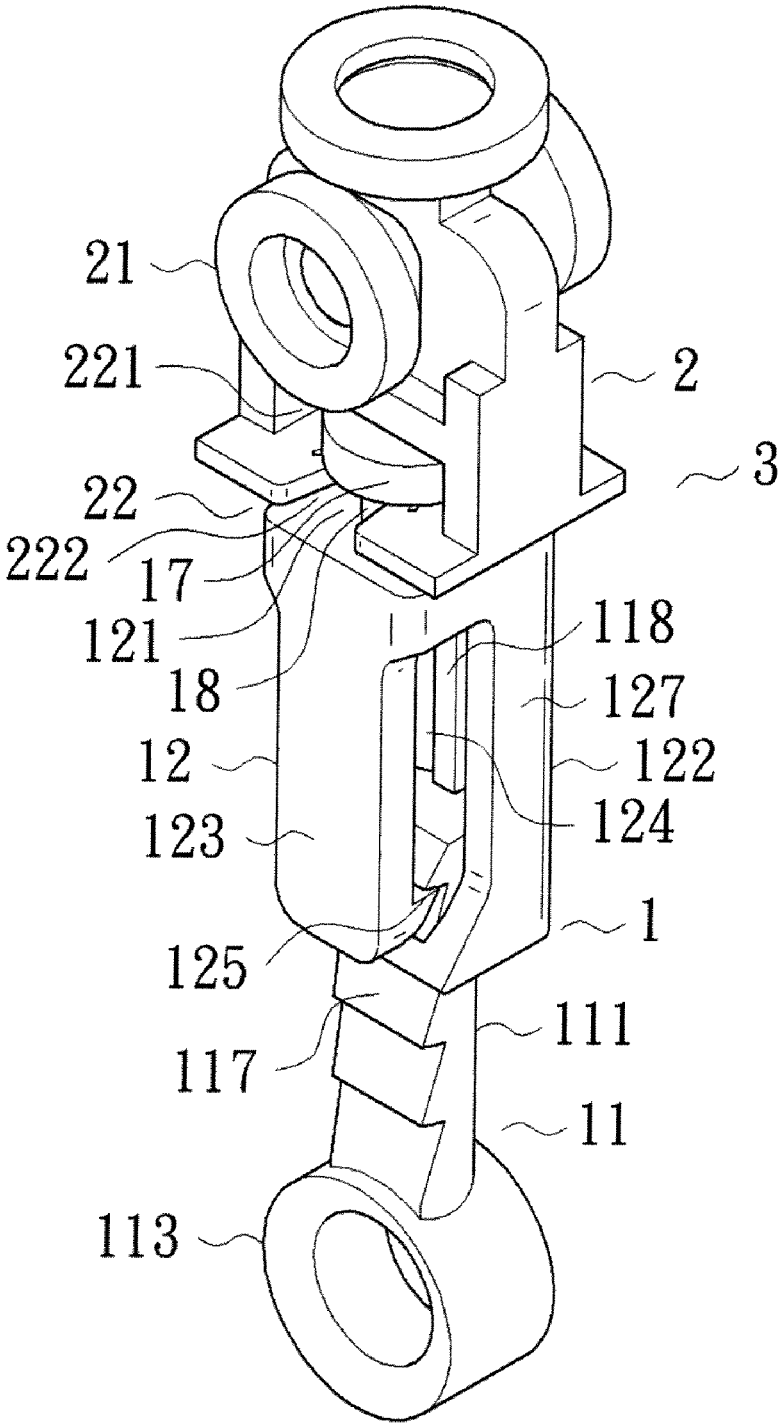
FIG. 7 shows a perspective view of a slide assembly for a window drape according to the present invention.
Figure 8:
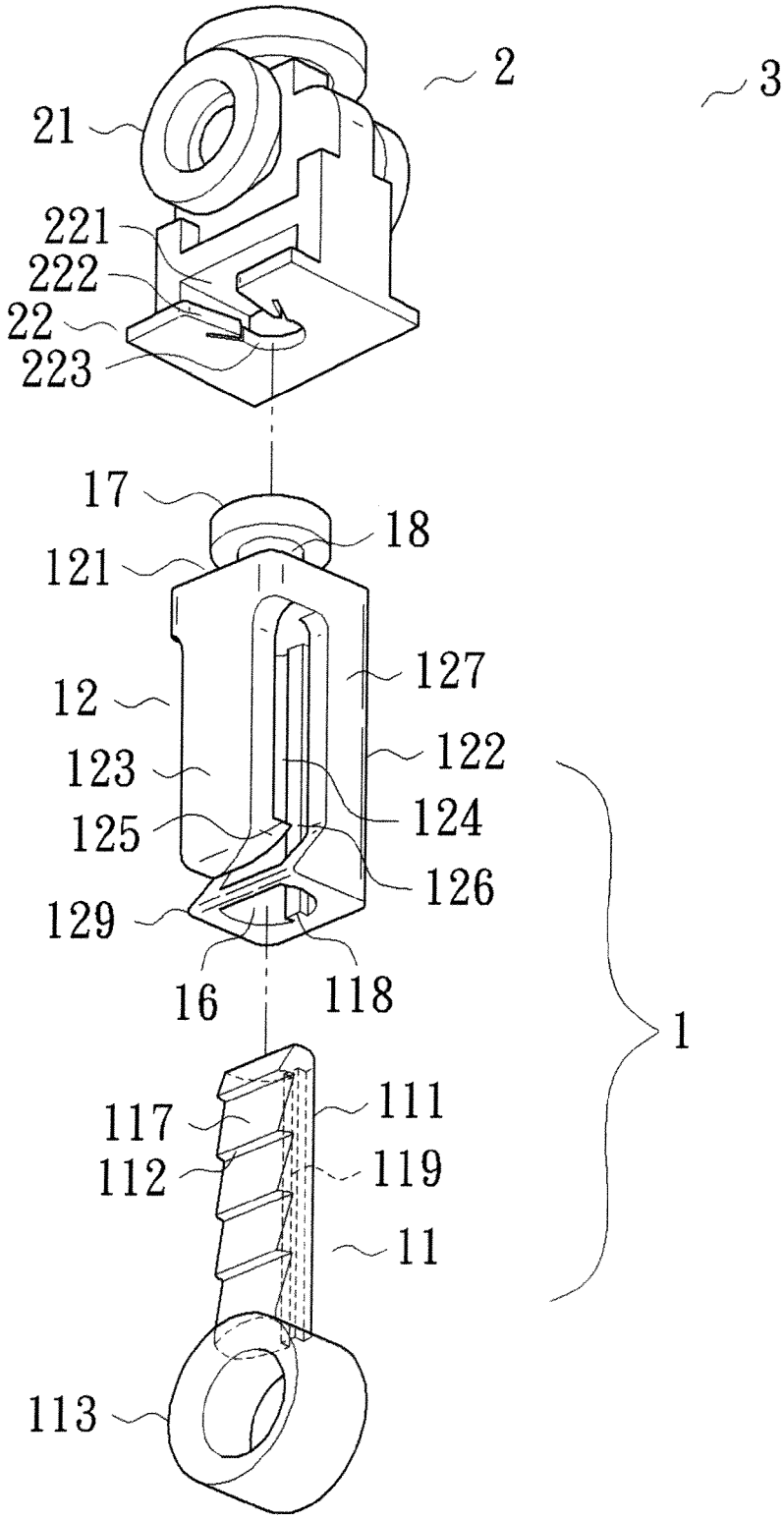
FIG. 8 shows an exploded, perspective view of the slide assembly of FIG. 7.

With reference to FIGS. 7 and 8, the connecting head 121 includes an engaging a head 17 and a neck 18. The connecting portion 22 includes a coupling groove 221. A bottom wall of the coupling groove 221 includes a holding hole 223 and an opening 222 in communication with the holding hole 223. The neck 18 can be inserted into the holding hole 223 via the opening 222. An outer diameter of the head 17 is larger than a diameter of the holding hole 223 and, thus abuts the bottom wall of the coupling groove 221 after assembly. By such an arrangement, the hanger 1 and the slide 2 can be assembled or detached easily.

Figure 10:
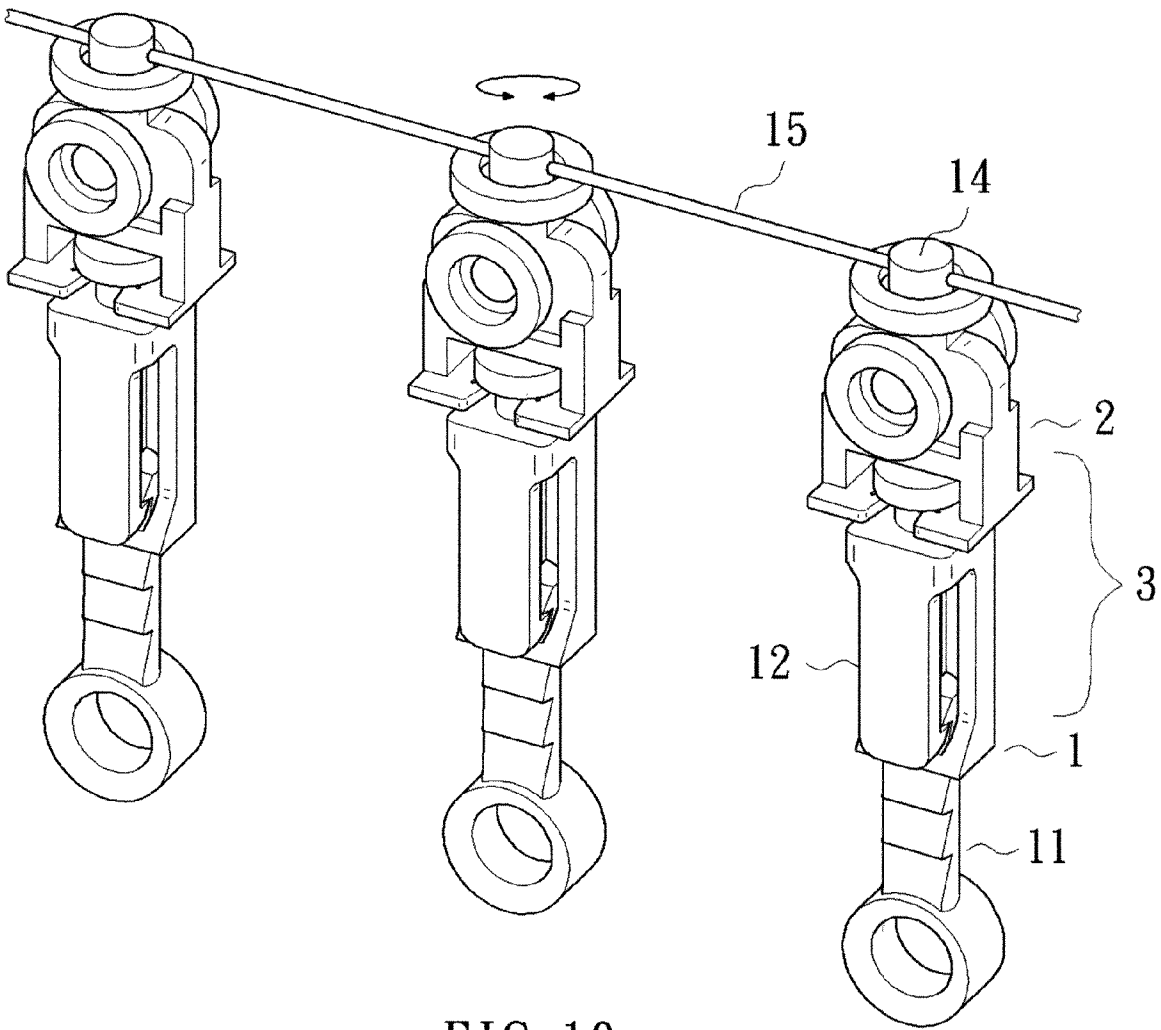
FIG. 10 shows a perspective view of a plurality of slide assemblies according to the present invention connected by a string.

With reference to FIG. 10, a carrier 14 is mounted on top of the slide 2 of each slide assembly 3. The carriers 14 are connected by the string 15 for drawing the slide assemblies 3 while allowing setting of the spacing between the slide assemblies 3. In the illustrated embodiment, each carrier 14 is rotatable relative to the top of the associated slide 2.

The body 122 and the rod 111 respectively include a rib 118 and a groove 119 on two mutually facing sides respectively of the body 122 and the rod 111. The groove 119 extends in a longitudinal side of the rod 111. The rib 118 is slideably received in the groove 119, allowing stable sliding movement of the rod 111.

The body 122 includes an annular rib 129 at the opening of the passageway 124. The annular rib 129 and the body 122 form a through-hole 16 through which the rod 111 extends. In the illustrated embodiment, the through-hole 16 has cross sections corresponding to those of the rod 111, providing stable sliding of the rod 111 in the passageway 124.

Although specific embodiments have been illustrated and described, numerous modifications and variations are still possible without departing from the essence of the invention. The scope of the invention is limited by the accompanying claims.

The invention claimed is:

1. A hanger comprising:

an elongated member including a rod and an engaging portion, with the rod including a side having a plurality of positioning portions spaced in a vertical direction, with the engaging portion formed on a bottom of the rod, with the engaging portion adapted to engage with an engagement portion; and a coupling block including a connecting head, with the coupling block further including a body and a resilient plate, with the body and the resilient plate located below the connecting head, with the body and the resilient plate together defining a passageway having an opening in a lower end thereof, with the rod slideable in the passageway in the vertical direction, with the resilient plate having a free end with a hook, with the hook spaced from the body by a spacing, with at least a portion of the hook extending into the passageway, with the hook releasably engaged with a selected one of the plurality of positioning portions, with the resilient plate being operable to disengage the hook from the plurality of positioning portions; with the body and the rod respectively including a rib and a groove on two mutually facing sides respectively of the body and the rod, with the groove extending in a longitudinal side of the rod, with the rib slideably received in the groove.

2. The hanger as claimed in claim 1, with the plurality of positioning portions including a plurality of positioning steps, with two of the plurality of positioning steps adjacent to each other being connected by an inclined face.

3. The hanger as claimed in claim 1, with the connecting head including a engaging groove in a top thereof, with the engaging groove adapted to engage with a carrier.

4. The hanger as claimed in claim 1, with the body including an annular rib at the opening of the passageway, with the annular rib and the body forming a through-hole through which the rod extends.

5. A slide assembly for a window drape comprising:

a slide including a sliding portion at an intermediate portion thereof, with the sliding portion adapted to allow the slide to slide along a track of the window drape, with the slide including a connecting portion at a bottom portion thereof; and a hanger including:

an elongated member including a rod and an engaging portion, with the rod including a side having a plurality of positioning portions spaced in a vertical direction, with the engaging portion formed on a bottom of the rod, with the engaging portion adapted to engage with an engagement portion; and a coupling block including a connecting head connected to the connecting portion of the slide, with the coupling block further including a body and a resilient plate, with the body and the resilient plate located below the connecting head, with the body and the resilient plate together defining a passageway having an opening in a lower end thereof, with the rod slideable in the passageway in the vertical direction, with the resilient plate having a free end with a hook, with the hook spaced from the body by a spacing, with at least a portion of the hook extending into the passageway, with the hook releasably engaged with a selected one of the plurality of positioning portions, with the resilient plate being operable to disengage the hook from the plurality of positioning portions; with the connecting head including a head and a neck, with the connecting portion including a coupling groove, with the coupling groove including a bottom wall having a holding hole and an opening in communication with the holding hole, with the neck inserted into the holding hole via the opening, with the head having an outer diameter larger than a diameter of the holding hole.

6. The slide assembly for a window drape as claimed in claim 5, with the plurality of positioning portions including a plurality of positioning steps, with two of the plurality of positioning steps adjacent to each other being connected by an inclined face.

7. The slide assembly for a window drape as claimed in claim 5, with the body and the rod respectively including a rib and a groove on two mutually facing sides respectively of the body and the rod, with the groove extending in a longitudinal side of the rod, with the rib slideably received in the groove.

8. The slide assembly for a window drape as claimed in claim 5, with the body including an annular rib at the opening of the passageway, with the annular rib and the body forming a through-hole through which the rod extends.

9. A hanger comprising:

an elongated member including a rod and an engaging portion, with the rod including a side having a plurality of positioning portions spaced in a vertical direction, with the engaging portion formed on a bottom of the rod, with the engaging portion adapted to engage with an engagement portion; and a coupling block including a connecting head, with the coupling block further including a body and a resilient plate, with the body and the resilient plate located below the connecting head, with the body and the resilient plate together defining a passageway having an opening in a lower end thereof, with the rod slideable in the passageway in the vertical direction, with the resilient plate having a free end with a hook, with the hook spaced from the body by a spacing, with at least a portion of the hook extending into the passageway, with the hook releasably engaged with a selected one of the plurality of positioning portions, with the resilient plate being operable to disengage the hook from the plurality of positioning portions; with the body including an annular rib at the opening of the passageway, with the annular rib and the body forming a through-hole through which the rod extends.

10. The hanger as claimed in claim 9, with the plurality of positioning portions including a plurality of positioning steps, with two of the plurality of positioning steps adjacent to each other being connected by an inclined face.

11. The hanger as claimed in claim 9, with the connecting head including a engaging groove in a top thereof, with the engaging groove adapted to engage with a carrier.

12. The hanger as claimed in claim 9, with the body and the rod respectively including a rib and a groove on two mutually facing sides respectively of the body and the rod, with the groove extending in a longitudinal side of the rod, with the rib slideably received in the groove.

13. A slide assembly for a window drape comprising:

a slide including a sliding portion at an intermediate portion thereof, with the sliding portion adapted to allow the slide to slide along a track of the window drape, with the slide including a connecting portion at a bottom portion thereof; and a hanger including:

an elongated member including a rod and an engaging portion, with the rod including a side having a plurality of positioning portions spaced in a vertical direction, with the engaging portion formed on a bottom of the rod, with the engaging portion adapted to engage with an engagement portion; and a coupling block including a connecting head connected to the connecting portion of the slide, with the coupling block further including a body and a resilient plate, with the body and the resilient plate located below the connecting head, with the body and the resilient plate together defining a passageway having an opening in a lower end thereof, with the rod slideable in the passageway in the vertical direction, with the resilient plate having a free end with a hook, with the hook spaced from the body by a spacing, with at least a portion of the hook extending into the passageway, with the hook releasably engaged with a selected one of the plurality of positioning portions, with the resilient plate being operable to disengage the hook from the plurality of positioning portions; with the body and the rod respectively including a rib and a groove on two mutually facing sides respectively of the body and the rod, with the groove extending in a longitudinal side of the rod, with the rib slideably received in the groove.

14. The slide assembly for a window drape as claimed in claim 13, with the plurality of positioning portions including a plurality of positioning steps, with two of the plurality of positioning steps adjacent to each other being connected by an inclined face.

15. The slide assembly for a window drape as claimed in claim 13, with the connecting head including a head and a neck, with the connecting portion including a coupling groove, with the coupling groove including a bottom wall having a holding hole and an opening in communication with the holding hole, with the neck inserted into the holding hole via the opening, with the head having an outer diameter larger than a diameter of the holding hole.

16. The slide assembly for a window drape as claimed in claim 13, with the body including an annular rib at the opening of the passageway, with the annular rib and the body forming a through-hole through which the rod extends.

17. A slide assembly for a window drape comprising:

a slide including a sliding portion at an intermediate portion thereof, with the sliding portion adapted to allow the slide to slide along a track of the window drape, with the slide including a connecting portion at a bottom portion thereof; and a hanger including:

an elongated member including a rod and an engaging portion, with the rod including a side having a plurality of positioning portions spaced in a vertical direction, with the engaging portion formed on a bottom of the rod, with the engaging portion adapted to engage with an engagement portion; and a coupling block including a connecting head connected to the connecting portion of the slide, with the coupling block further including a body and a resilient plate, with the body and the resilient plate located below the connecting head, with the body and the resilient plate together defining a passageway having an opening in a lower end thereof, with the rod slideable in the passageway in the vertical direction, with the resilient plate having a free end with a hook, with the hook spaced from the body by a spacing, with at least a portion of the hook extending into the passageway, with the hook releasably engaged with a selected one of the plurality of positioning portions, with the resilient plate being operable to disengage the hook from the plurality of positioning portions; with the body including an annular rib at the opening of the passageway, with the annular rib and the body forming a through-hole through which the rod extends.

18. The slide assembly for a window drape as claimed in claim 17, with the plurality of positioning portions including a plurality of positioning steps, with two of the plurality of positioning steps adjacent to each other being connected by an inclined face.

19. The slide assembly for a window drape as claimed in claim 17, with the connecting head including a head and a neck, with the connecting portion including a coupling groove, with the coupling groove including a bottom wall having a holding hole and an opening in communication with the holding hole, with the neck inserted into the holding hole via the opening, with the head having an outer diameter larger than a diameter of the holding hole.

20. The slide assembly for a window drape as claimed in claim 17, with the body and the rod respectively including a rib and a groove on two mutually facing sides respectively of the body and the rod, with the groove extending in a longitudinal side of the rod, with the rib slideably received in the groove.

* * * * *